United States Patent [19]

Mikami et al.

[11] Patent Number: 4,916,360

[45] Date of Patent: Apr. 10, 1990

[54] THIN FILM ELECTROLUMINESCENT DEVICE WITH ZNS AS HOST MATERIAL

[75] Inventors: Akiyoshi Mikami, Yamatotakada; Takashi Ogura, Nara; Kouji Taniguchi; Masaru Yoshida, both of Nara, all of Japan

[73] Assignee: Sharp Kabushiki Kaisha, Osaka, Japan

[21] Appl. No.: 216,270

[22] Filed: Jul. 7, 1988

[30] Foreign Application Priority Data

Jul. 8, 1987 [JP] Japan ..... 62-170314

[51] Int. Cl.[4] ..... H05B 33/14; H05B 33/18

[52] U.S. Cl. ..... 313/503; 313/509; 252/301.6 S; 428/690; 428/917

[58] Field of Search ..... 313/503, 509; 252/301.4 S, 301.4 H, 301.6 S; 428/690, 691, 917

[56] References Cited

U.S. PATENT DOCUMENTS 4,707,419 11/1987 Ogura et al. ..... 313/503 X 4,758,765 7/1988 Mitsumori ..... 313/503 X

*Primary Examiner*—Kenneth Wieder

[57] ABSTRACT

A thin film electroluminescent (EL) device which emits a luminescence in response to the application of an electric field, and comprises ZnS as a host material and a rare earth element providing luminescent centers.

15 Claims, 2 Drawing Sheets

THIN FILM ELECTROLUMINESCENT DEVICE WITH ZNS AS HOST MATERIAL

BACKGROUND OF THE INVENTION

1. Field of the Invention

The present invention relates to a thin film electroluminescent (EL) device which emits a luminescence in response to the application of an electric field, and more particularly to such a device which comprises ZnS as a host material and a rare earth element providing luminescent centers.

2. Description of the Prior Art

The thin film EL devices presently in use comprise an EL film which is composed of ZnS serving as a host material and doped with Mn providing luminescent centers. These devices, however, are limited to yellowish organge in the color of luminescence. Accordingly, EL devices are desired which luminesce in the three primary colors, i.e. red, green and blue, as required for realizing a full-color luminescence. For this purpose, research is conducted on the use of rare earth elements as luminescent centers. For example, Tb, Sm and Tm, when used, are thought to produce green, red and blue luminescences, respectively.

Such an EL film comprising the host material ZnS doped with a rare earth element is prepared usually by radio-frequency (rf) sputtering or electron beam vacuum evaporation using these materials, i.e. ZnS and a halide or oxide of the rare earth element, in combination. For example, an EL film (ZnS: Tb, F) prepared from a target consisting of the mixture of ZnS and the fluoride of a rare earth element (e.g. $TbF_3$) by a sputter technique is known to have some degree of luminescence brightness (Unexamined Japanese Patent Publication SHO No. 61-273894).

However, conventional EL devices comprising such an EL film containing the rare earth element still remain to be improved in luminescence brightness and efficiency for actual use.

For example, with reference to the broken line in FIG. 1 representing the optical excitation spectrum of the above-mentioned ZnS:Tb, F EL film (Tb concentration: about 2 at. %) which produces a green luminescence, the spectrum has excitation bands at about 380 nm and about 335 nm, but the intensity of excitation is low.

Although the excitation mechanism at the luminescent centers has yet to be fully explained, it appears likely that hot electrons accelerated by a high electric field and having high energy will collide with the luminescent centers (direct collision excitation), or the recombination energy of electron-hole pairs released from the host ZnS upon impact ionization will be delivered to the luminescent centers by resonance transfer (band excitation). Accordingly, it is thought that the above-mentioned excitation bands correspond to these respective excitation mechanisms. Nevertheless, in the case of the direct collision excitation of luminescent centers of the rare earth element, it is difficult to achieve a greatly improved excitation efficiency since the luminescence of the rare earth ion is inherently due to forbidden transition. Further in the case of band excitation, the recombination energy of electron-hole pairs is transferred to the rare earth ion only with a very low efficiency and is predominantly converted to thermal energy. Presumably for these reasons, the conventional EL film is unable to exhibit a high excitation intensity at either of the excitation bands as indicated in the broken line in FIG. 1, failing to give sufficient luminescence brightness.

To obviate the drawback, it is required to improve the crystallinity of the host by resorting to film forming techniques other than the conventional sputtering process and vacuum evaporation process, whereas difficulties are encountered in fulfilling this requirement in respect of amenability to quantity production and cost.

The main object of the present invention, which has been accomplished in view of the above problem, is to improve the luminescence brightness of EL films having luminescent centers afforded by a rare earth element.

SUMMARY OF THE INVENTION

We have investigated in detail the relationship of the conditions for forming EL films or the material thereof with the excitation spectrum thereof and found that when ZnS:RE (RE stands for a rare earth element) films have an S to Zn atomic ratio, i.e. S/Zn, in excess of 1 (stoichiometric ratio), a complex center comprising the rare earth ion as combined with a detect in the host ZnS can be formed which has a high excitation efficiency to accomplish the present invention.

The present invention provides a thin film EL device which comprises an EL film made of ZnS serving as its host material and doped with a rare earth element to provide luminescent centers, the EL film having a ratio of S atoms to Zn atoms, i.e. S/Zn, in the controlled range of $1.02 \leqq S/Zn \leqq 1.13$, insulating layers sandwiching the EL film, and a pair of electrodes provided on the respective outer surfaces of the insulating layers.

DESCRIPTION OF THE PREFERRED EMBODIMENT

Figure 1:
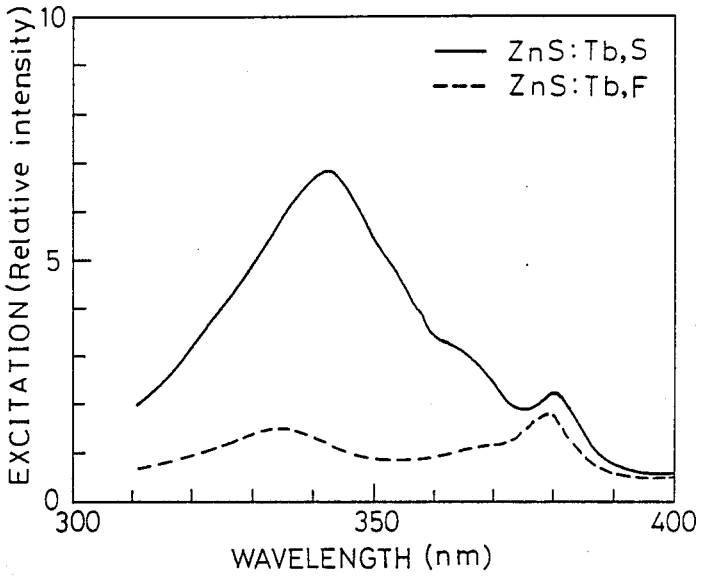
FIG. 1 is a diagram showing the optical excitation spectrum of a ZnS:Tb, S film and that of a ZnS:Tb, F film for comparison.

The host material ZnS of the EL film of the invention has an atomic ratio S/Zn in the range of 1.02 to 1.13. If this ratio is less than 1.02, a sufficient increase will not be achieved in luminescence brightness, whereas if it is in excess of 1.13, the ZnS will exhibit impaired characteristics as a semiconductor and is liable to be lower in luminescence brightness and therefore unsuitable.

Examples of rare earth elements suitable for doping the EL film are those having an atomic number of 59 to 69 (Pr to Tm), among which Tb, Sm, Tm, Eu and Pr are desirable. The proper element is selected in accordance with the desired luminescence color. The film is doped with such a rare earth element in an amount suitably of 0.5 to 3 at. %.

The EL film is formed by the physical vapor deposition process resorting to sputtering, vacuum evaporation or the like on a substrate suitable for EL devices and having on its surface an ITO or like electrode which is covered with an insulating layer. More specifically, the EL film is prepared, for example, by radio-frequency sputtering or electron beam vacuum evaporation using ZnS and a sulfide of rare earth element, such as $Tb_2S_3$, $Sm_2S_3$, $Tm_2S_3$, as a compound for supplying the desired rare earth element. Since the process incorporates an excessive amount of S atoms into the film along with the rare earth element, the S/Zn ratio of the EL film can be controlled to the range of 1.02 to 1.13 easily by adjusting the amount of the sulfide. For example, $Tb_2S_3$, when used, is adjusted to such an amount that 0.5 to 3 at. % of Tb will be present in the film, whereby the S/Zn ratio is controllable to the above range. Usually, it is suitable that the substrate temperature be 150 ° to 200° C. for vacuum evaporation or 150 ° to 250° C. for sputtering.

Instead of using the sulfide of rare earth element, incorporation of an excessive amount of S atoms is also possible to effect vacuum evaporation or sputtering in the presence of $H_2S$ gas or with addition of elemental S to the material.

It is further possible to form an EL film first with an S/Zn ratio of 1.0 and thereafter heat-treat the film in an S gas atmosphere.

Other processes, such as the ALE process and MBE process can also be resorted to.

Generally, it is suitable that the EL film formed be 0.3 to 1.5 μm in thickness.

The EL film formed is then covered with an insulating layer, on which an electrode is further formed. When required, a protective layer of seal glass or the like, a layer filled with an inulating oil, other attachment are provided on the resulting assembly to give a thin film EL device of the invention. Examples of useful insulating materials for the insulating layers of the present device are those usually used, such as $Al_2O_3$, $SiO_2$, $Y_2O_3$, $TiO_2$, $HfO_2$ and $Si_3N_4$, and a composite material composed of such compounds. Also usable are highly dielectric materials. Generally, it is suitable that each insulating layer be 0.05 to 1.0 μm in thickness.

An ITO or like transparent electrode is used as at least one of the pair of electrodes. The other electrode can be, for example, a film of Al, Ni, Au or the like formed by vacuum evaporation.

EXAMPLE

An example is given below wherein an excessive amount of S atoms are supplied along with Tb in forming an EL film by using Tb sulfide ($Tb_2S_3$) as a material for providing luminescent centers (rare earth element supplying compound).

An EL device of the following structure was prepared by the method described below. First, a glass substrate bearing a transparent electrode (ITO film) was coated with a lower insulating layer having a thickness of about 2000 angstroms and composed of $Si_3N_4$ and $SiO_2$ by radio-frequency sputtering. A ZnS:Tb, S film, about 8000 angstroms in thickness, was formed over the layer similarly by radio-frequency sputtering using a finely divided mixture of ZnS and $Tb_2S_3$ as the target. The film was further coated with an upper insulating layer having a thickness of about 2000 angstroms and composed of $Si_3N_4$ and $Al_2O_3$. Finally an Al film was formed on this insulating layer by vacuum evaporation to provide an upper electrode. For comparison, another EL device was prepared in the same manner as above except that $TbF_3$ conventionally used was employed in place of $Tb_2S_3$ to form a ZnS:Tb, F film.

Figure 2:
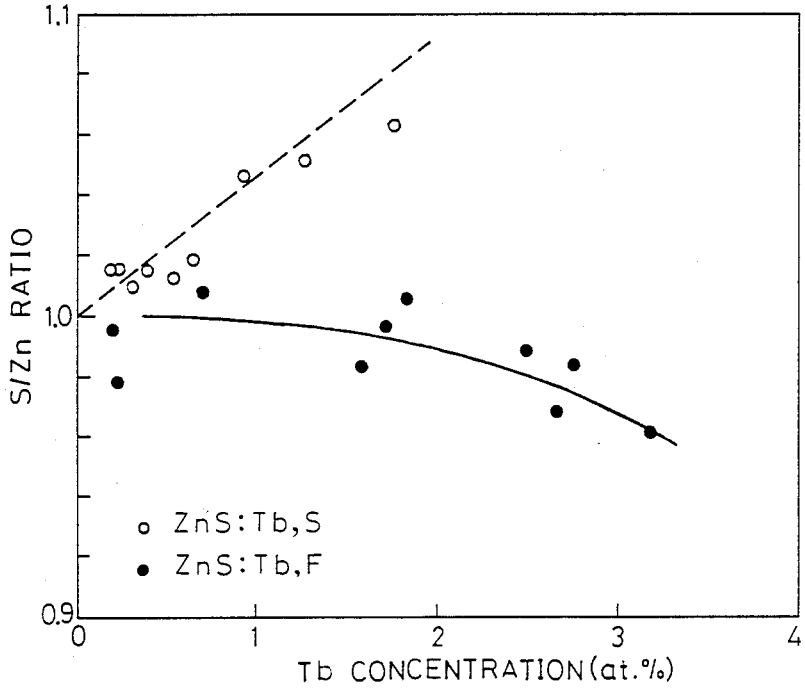
FIG. 2 is a diagram showing the Tb concentration dependence of the S/Zn ratio of the same films.

FIG. 2 shows variations in the S/Zn ratio of EL films at varying Tb concentrations. For providing luminescent centers, $Tb_2S_3$ and $TbF_3$ were used for the respective EL films (referred to as ZnS:Tb S film and ZnS:Tb, F film, respectively). When the Tb concentration is low, i.e. below about 0.5 at. %, the S/Zn ratio of either film is about 1 and is close to the stoichiometric ratio. At higher Tb concentrations, the S/Zn ratio of the ZnS:Tb, F film is 1 or lower, whereas the same ratio of the ZnS:Tb, S film tends to increase beyond 1, indicating that an excessive amount of S atoms are incorporated in the film.

Figure 3:
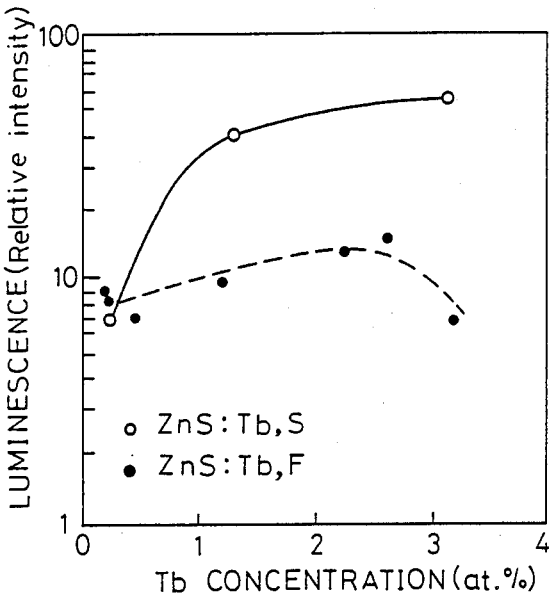
FIG. 3 is a diagram showing the Tb concentration dependence of the luminescence intensity of the same.

FIG. 1, the solid line represents the optical excitation spectrum of the ZnS:Tb, S film having an S/Zn ratio of 1.025. At a peak wavelength of about 342 nm, the spectrum reveals a new band of very strong excitation which differs from direct collision excitation or band excitation. FIG. 3 shows the Tb concentration dependence of the luminescence intensity of the EL film when the new excitation band is selectively excited. At Tb concentrations of below 0.5 at. %, there is no difference between the ZnS:Tb, S film and the ZnS:Tb, F film, but at higher Tb concentrations, the luminescence intensity of the ZnS:Tb, S film remarkably increases. This result closely matches the Tb concentration dependence of the S/Zn ratio of the same film shown in FIG. 2 and is attributable to the presence of an excess of S atoms, beyond the stoichiometric ratio, which affords a new excitation level of high efficiency.

We have investigated the new excitation band in detail as to the temperature characteristics of the excitation intensity, the influence of heat treatment on the intensity, the Tb concentration dependence of the intensity, etc. and found that the band is due to the presence of Tb related complexes associated with sulfur interstitials.

Figure 4:
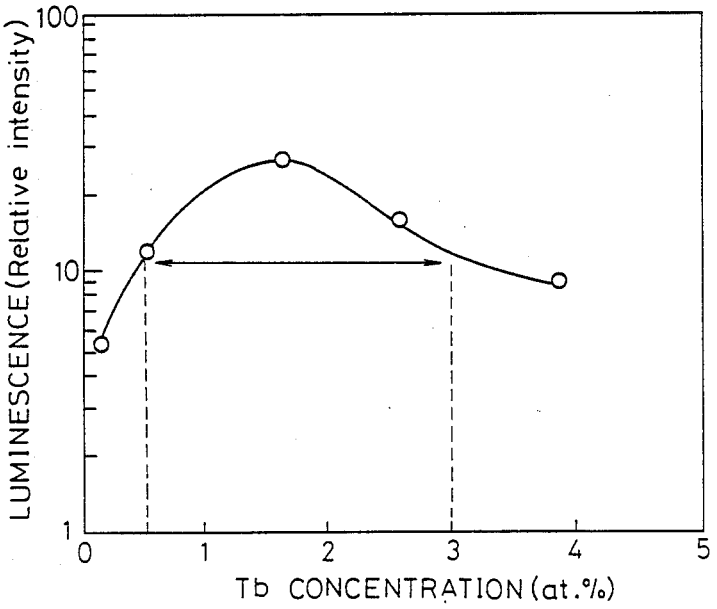
FIG. 4 is a diagram showing the Tb concentration dependence of the luminescence intensity of the EL device of the invention.

FIG. 4 shows the Tb concentration dependence of the luminescence intensity of the EL device incorporating the ZnS:Tb, S film. The luminescence intensity steadily increases as the Tb concentration increases to about 2 at. % but conversely decreases as the concentration further increases. This is attributable to the absolutely small amount of Tb in the range of low concentrations and the diminished energy of hot electrons in the range of high concentrations where electrons are subjected to impurity scattering due to Tb, with the result that Tb is not excited efficiently in these concentration ranges. Accordingly, relatively high brightness is available in the Tb concentration range of 0.5 to 3 at. %.

As already stated, the excessive S atoms combine with Tb to form complex centers of high excitation efficiency, so that the concentration of excessive S atoms should be nearly equal to the Tb concentration. In view of the fact that in the ZnS film, Tb ion is present in the Zn site, the relationship between the S/Zn ratio of the film and the Tb concentration thereof can be expressed by the equation $$S/Zn = \frac{50 + C_{Tb}}{50 - C_{Tb}} \quad (1)$$

wherein $C_{Tb}$ is the Tb concentration (at. %). This relationship closely matches the experimental values indicated by the broken line of FIG. 2. It therefore follows that the S/Zn ratio required for the optimum Tb concentration range of 0.5 to 3 at. %, as calculated from Equation (1), is in the range of:

$$1.02 \leqq S/Zn \leqq 1.13$$

While Tb serves as the element for providing luminescent centers in the example given above, it is known that the eleven elements with an atomic number of 59 to 69, i.e. Pr to Tm, are the same as Tb in excitation process and closely resemble one another, so that the same effect as already described above can be achieved by these rare earth elements.

To sum up, the present invention provides a thin film EL device of the ZnS type wherein a rare earth element affords luminescent centers and which is adapted to achieve an increased excitation efficiency at the luminescent centers to exhibit improved luminescence brightness by making the S/Zn ratio of the ZnS film greater than the stoichiometic ratio, that is by giving the film an S/Zn ratio of 1.02 to 1.13.

What we claimed is:

1. A thin film EL device which comprises an EL film made of ZnS serving as its host material and doped with a rare earth element to provide luminescent centers, the EL film having a ratio of S atoms to Zn atoms (S/Zn) in the controlled range of $1.02 \leqq S/Zn \leqq 1.13$, insulating layers sandwiching the EL film and a pair of electrodes provided on the respective outer surfaces of the insulating layers.

2. The EL device of claim 1 in which the rare earth element is selected from the group of those having an atomic number of 59 to 69.

3. The EL device of claim 1 in which the rare earth element is selected from the group consisting of Tb, Sm, Tm, Eu and Pr.

4. The EL device of claim 1 in which the concentration of the rare earth element in the EL film is 0.5 to 3 at. %.

5. The EL device of claim 1 in which the EL film is 0.3 to 1.5 μm in thickness.

6. The EL device of claim 1 in which the EL film is prepared by a sputtering or vacuum evaporation method using ZnS and a sulfide of the rare earth element.

7. The EL device of claim 6 in which the rare earth element is selected from the group consisting of Tb, Sm, Tm, Eu and Pr.

8. The EL device of claim 3 in which the concentration of the rare earth element in the EL film is 0.5 to 3 at. %.

9. The EL device of claim 8 in which the EL film is prepared by a sputtering or vacuum evaporation method using ZnS and a sulfide of the rare earth element.

10. The EL device of claim 9 in which the EL film is 0.3 to 1.5 μm in thickness.

11. A thin film EL device which consists essentially of an EL film made of ZnS serving as its host material and doped with a rare earth element to provide luminescent centers, the EL film having a ratio of S atoms to Zn atoms (S/Zn) in the controlled range of $1.02 \leqq S/Zn \leqq 1.13$, insulating layers sandwiching the EL film and a pair of electrodes provided on the respective outer surfaces of the insulating layers, wherein the EL film is prepared by using ZnS and a sulfide of the rare earth element.

12. The EL device of claim 1 in which the rare earth element is selected from the group of those having an atomic number of 59 to 69.

13. The EL device of claim 11 in which the rare earth element is selected from the group consisting of Tb, Sm, Tm, Eu and Pr.

14. The EL device of claim 11 in which the concentration of the rare earth element in the EL film is 0.5 to 3 at. %.

15. The EL device of claim 11 in which the EL film is 0.3 to 1.5 μm in thickness.

* * * * *